US007686195B2

(12) United States Patent
Bangert

(10) Patent No.: US 7,686,195 B2
(45) **Date of Patent: *Mar. 30, 2010**

(54) CHILD CARRIER

(76) Inventor: John G. Bangert, 647 Irene Way, Placentia, CA (US) 92870

( * ) Notice: Subject to any disclaimer, the term of this patent is extended or adjusted under 35 U.S.C. 154(b) by 975 days.

This patent is subject to a terminal disclaimer.

(21) Appl. No.: 11/397,405

(22) Filed: Apr. 5, 2006

(65) Prior Publication Data

US 2007/0235479 A1 Oct. 11, 2007

(51) Int. Cl.
*A61G 1/00* (2006.01)

(52) U.S. Cl. ..... 224/159; 224/627

(58) Field of Classification Search ..... 224/159
See application file for complete search history.

(56) References Cited

U.S. PATENT DOCUMENTS 5,603,441 A * 2/1997 Easter ..... 224/582
5,711,466 A * 1/1998 Kataoka et al. ..... 224/159
6,186,381 B1 * 2/2001 Kernkamp ..... 224/161
6,789,710 B1 * 9/2004 Szatkowski ..... 224/159
6,837,406 B2 * 1/2005 Sclafani ..... 224/159
D553,348 S * 10/2007 Bangert ..... D3/213
2002/0162864 A1 * 11/2002 Grunwald ..... 224/159

FOREIGN PATENT DOCUMENTS

EP 0355223 * 2/1990
GB 2270619 * 3/1994
GB 2343104 * 5/2000

* cited by examiner

*Primary Examiner*—Tri M Mai
(74) *Attorney, Agent, or Firm*—Edward E. Roberts

(57) ABSTRACT

A child carrier to be worn by a user for supporting and transporting a child including a child seating portion, a buttress support portion depending downwardly from the front end of the seating portion for abutting the body of the user supporting the child, and first and second sides downwardly depending from the seating portion to connect and brace the seating portion and the buttress support portion. The seating portion is configured for receiving a child in the user facing position, is laterally contoured generally convexly, and extends backwardly and upwardly in a generally concave manner from said buttress support portion. The carrier has slits appropriately positioned for attachment of adjustable shoulder and waist straps.

5 Claims, 2 Drawing Sheets

CHILD CARRIER

BACKGROUND

The background of the invention will be discussed in two parts.

FIELD OF THE INVENTION

The invention relates generally to a child carrying device, and particularly to a single piece carrier worn by an adult that is generally contoured to the body of an adult for transporting the child in a natural manner upon the hip or abdomen of an adult person.

DESCRIPTION OF THE RELATED ART

Child carriers which permit a user to transport a child either on one's back or hip are well known. These carriers typically comprise a framework fabricated from pieces of aluminum tubing or PVC piping that includes a seat in which a child is placed. The seat is typically secured to the user by shoulder and waist straps. However, even though current art child carriers often are adjustable, by means of the shoulder and waist straps, to provide a more comfortable carrying position for different sized users, both the aluminum tubing and PVC piping frames are inadequate in providing sufficient comfort to prevent premature fatigue of the adult user. These frameworks also provide inadequate comfort for the child.

One such prior art child carrier is disclosed in U.S. Pat. No. 6,535,342 issued to Sundara, et al. on 10 Jun. 2003. Sundara et al. discloses a child carrier worn on the back of an adult, the carrier including a rigid frame having front and rear sections, the front section adjacent to the user's back and comprised of a pair of rigid columnar members. A restraint system includes shoulder, waist and crotch straps.

Another prior art child carrier is disclosed in U.S. Pat. No. 5,441,186 issued to Halligan on 15 Aug. 1995. Halligan discloses a child carrier comprising a basic framework fabricated from piping and a seat with removable seat back, both of a canvass material. The carrier is worn on the adult's hip and includes supporting shoulder and waist straps.

A further prior art child carrier is disclosed in U.S. Pat. No. 4,901,898 issued to Colombo, et al. on 20 Feb. 1990. Colombo et al. discloses a back-less child carrier attached to a waist belt whereby the weight of the child is distributed only about the wearer's waist and hip region. The back-less seat has a portion contoured to the hip region of the user and a portion contoured to receive and support the legs and buttocks of the child.

These patents are illustrative of the various approaches made to satisfy the existing need for improved child carriers; however, the related art concepts remain limited in this regard.

The present invention satisfies the existing need for improved child carriers by providing a unitary carrier seat contoured both to properly fit against the user's hip and abdomen and for the child to comfortably sit in an inward-facing position. The seat is contoured for comfortably positioning and supporting the child as well as contoured for the child's legs to comfortably straddle the user. An abruptly raised back portion is provided to limit any tendency of the child to slide backward on the seat. The raised back thus provides increased safety as well as a psychological feeling of safety for the child. A downward extending portion is provided for increased support and stability. The carrier has slits for attachment of adjustable shoulder and waist straps, the shoulder straps providing for distribution of the child's weight over the adults torso, thus relieving the user from uncomfortable "cutting" waist pressure of a belt-only child carrier. The straps further provide means for mounting storage pouches for such cleaning and nurturing items as may be needed when transporting a child.

It is thus an aspect of the present invention to provide a new and improved child carrier that provides comfortable and safe support for a child.

It is another aspect of the present invention to provide a new and improved child carrier that includes means for storage of child cleaning and nurturing items.

It is a further aspect of the present invention to provide a new and improved child carrier that may be mounted on the hip or stomach of an adult user and provides waist and shoulder strapping support for comfort and weight distribution of the weight of the child.

It is also an aspect of the invention to provide an improved unitary child carrier having contours configured and positioned for both user and child comfort.

It is yet another aspect of the present invention to provide an improved single piece generally child carrier having a seating platform contoured for comfortable placement of the child's buttocks and legs, an abruptly raised back for child physical and psychological security, and a downwardly extending portion providing child support and carrier position stability during use.

Other aspects, features and advantages of the invention will become apparent from a reading of the specification, when taken in conjunction with the drawings, in which like reference numerals refer to like elements in the several views.

SUMMARY

There is provided a child carrier having a child seating portion contoured for child comfort and safety, and a carrier portion contoured for stable placement of the child carrier against the user's body. The seat is designed for inward-facing of the child with the child's legs generally straddled around the user's torso and the child seating portion extending outward and upward from the user's body. The contoured carrier portion extends downward from the child seating portion to thereby provide a support brace for increased support, comfort and stability. The child carrier has slits appropriately positioned for attachment of adjustable shoulder and waist straps.

DRAWINGS

DESCRIPTION

Figure 1:
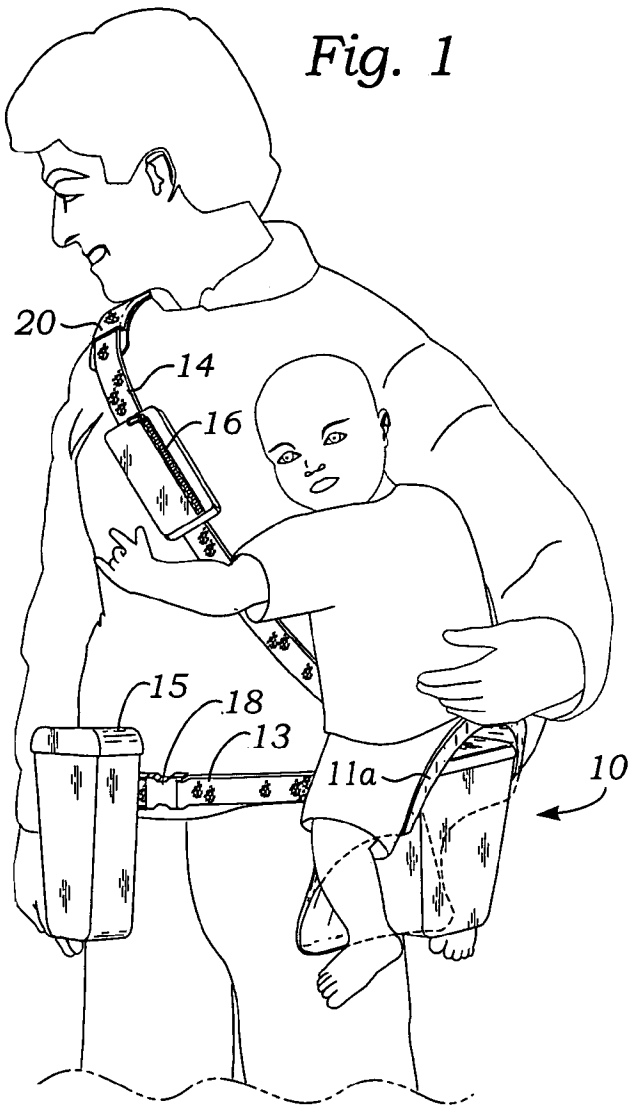
FIG. 1 illustrates the invention as worn by the user showing attachment of the shoulder and waist straps, along with accessory pouches.

Referring to the drawings in general there is illustrated and disclosed a unique unitary child carrier adapted to be worn on the hip or abdomen of the user and which is secured to the user's body by belt strapping about the user's waist and weight distribution strapping about a shoulder of the user. The child carrier is constructed to have sufficient strength to support the expected child weight. It can be molded of plastic, or the like, or by any other adequate process such as vacuum formed, stamped or lay up. The carrier includes contoured seating surfaces providing child and user comfort and safety, as well as a depending contoured surface providing stable positioning on the body of the user. The child carrier may be constructed of generally rigid plastic, pliable plastic, resin, rubber or other suitable material. It may be unitary and generally rigid or constructed of several parts and pliable to more aptly conform to the contour of the user. Accordingly, FIG. 1 illustrates the invention as may be worn by an adult user. The child carrier of the invention, generally designated 10, is shown designed for inward-facing of the child with the child's legs generally straddled around the user's hip or upper leg. Although shown positioned on the user's left hip, it is understood that it can be worn on the user's right hip or in front on the user's abdomen as well.

Figure 2:
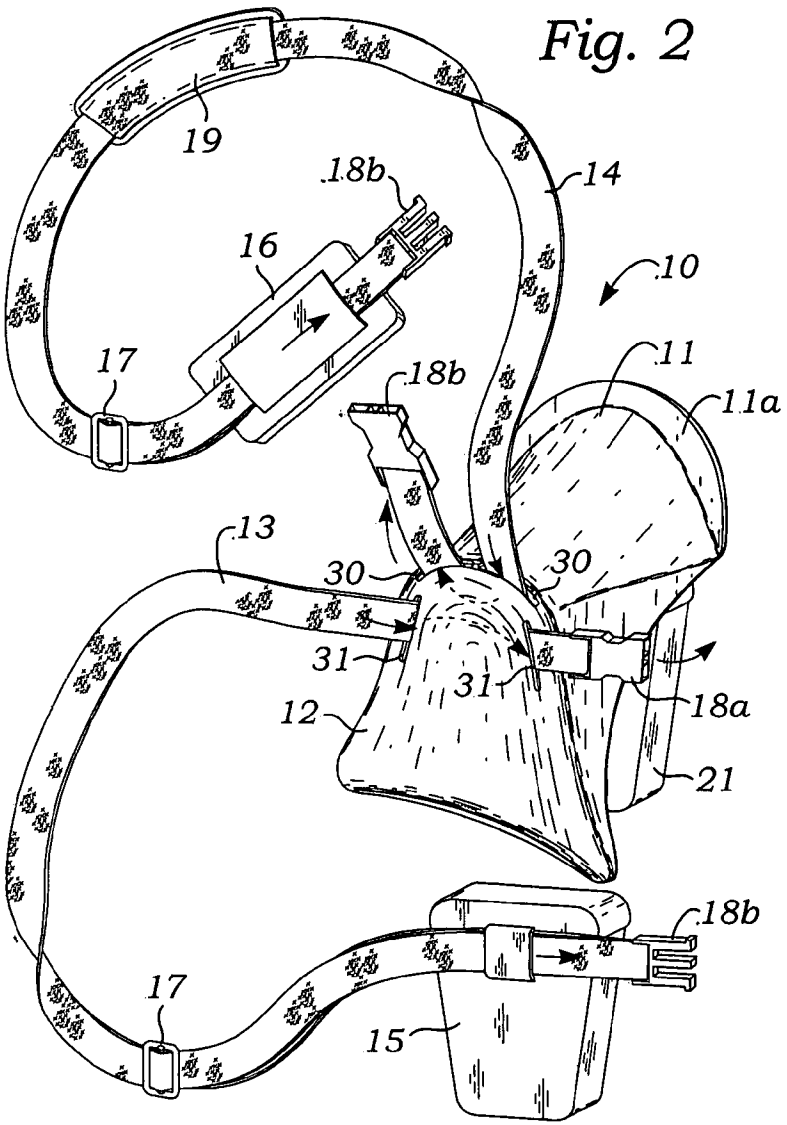
FIG. 2 illustrates attachment of the waist and shoulder straps to the invention of FIG. 1.
Figure 3:
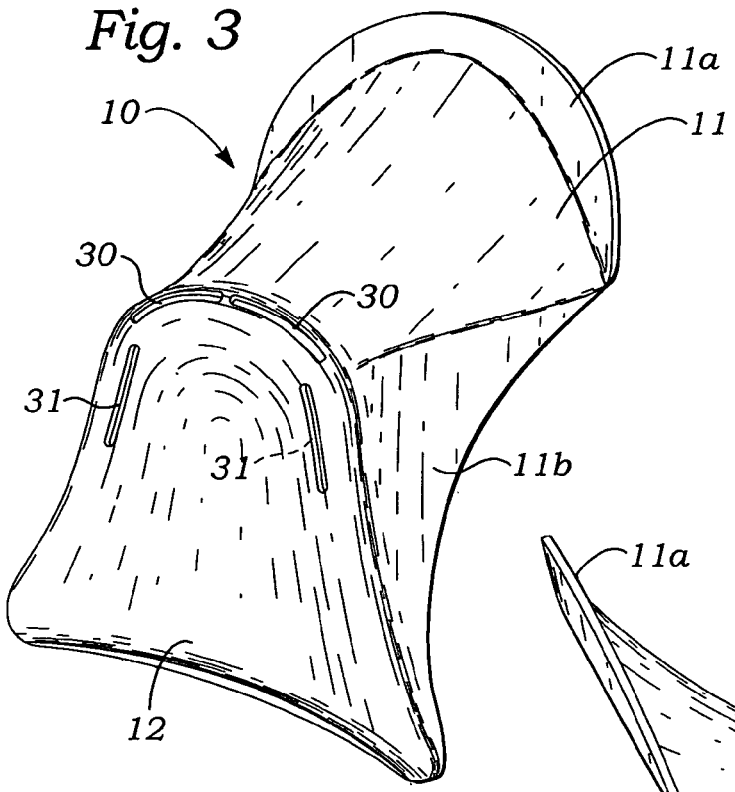
FIG. 3 is a perspective view of the child carrier of FIG. 1 showing the seating portion, raised back, adult body contoured portion, and contoured left side of the seating portion.
Figure 5:
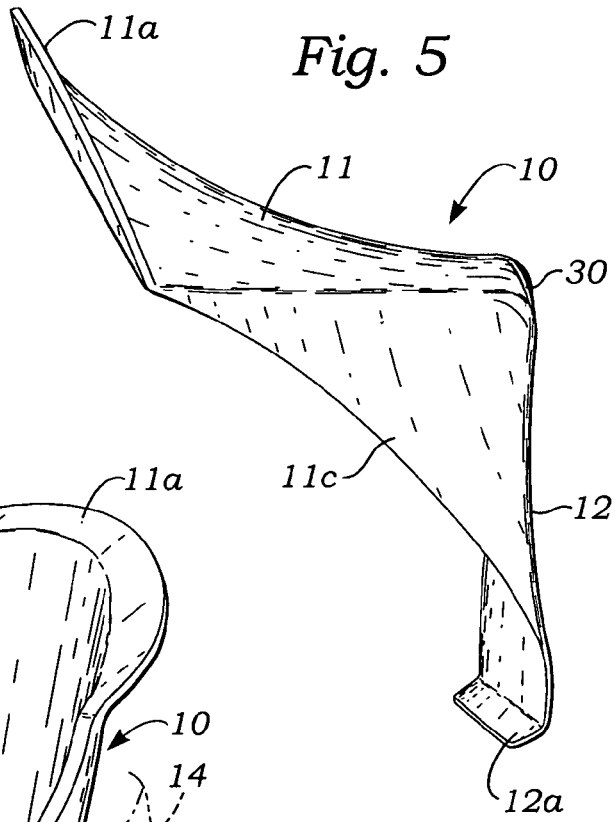
FIG. 5 is a right side view of the child carrier of FIG. 1.

The structure of the carrier 10 is shown in greater detail in FIGS. 2-5 where it may be seen to include a child seating portion 11, an upturned back stop portion 11*a*, buttress portion 12, and left and right side portions 11*b* and 11*c*. The child seating portion 11 is laterally convexly contoured, extending backwardly and upwardly in a concave manner from buttress portion 12 and terminating in an upturned portion 11*a*, the seating portion 11 thus sized and configured to minimize any tendency of the child to slide backwardly on the seating portion 11. Thus, the seat 11 combination of lateral convexity, rearward concavity terminating in slightly upturned portion 11*a* serve to position the child forwardly on the seat 11 and against the user, and therefore provide additional security for the child as well as aiding in child perceived security. This unique combination of lateral convexity and rearward concavity of seat 11 is best illustrated by FIGS. 3 and 5.

Seating portion 11 further includes downwardly depending and contoured left and right side portions 11*b* and 11*c*, respectively, these side portions 11*b*, 11*c* designed and contoured for comfortably accepting the inward-facing child's thighs for straddling the adult user. Thus, the convex design of the seating portion 11 downward to the thigh contoured side portions 11*b* and 11*c* cooperate to limit the child's side-to-side movement by the natural downward position of the buttocks and thigh, thus adding comfort to the child and increasing control by the adult user. Likewise, the inward slope of the seating portion 11 forces the child to slide downward into the adult, thus limiting the child from pushing away and increasing the tendency for the child to straddle the user. Further, the thigh contoured side portions 11*b* and 11*c* allows the child's legs to rest in a natural position thus to decrease restriction of blood flow that would cause discomfort to the legs and thigh.

Elongated buttress portion 12 is depends downwardly from the seating portion 11 and is concavely contoured to abuttingly fit comfortably against the user's body, the elongation and contour in combination providing a stable "hugging" condition of the carrier 10 onto the body of the user. Buttress portion 12 thus sustains and distributes the weight of the child thereby providing additional comfort to the adult user by relieving stress about the waist and on the shoulder of the user. Outwardly curved portion 12*a* may be included for added user comfort.

Child carrier 10 is secured to the user's body by flexible waist belt 13 which is fastened about the user's waist, and a weight distribution flexible shoulder harness 14 fastened which is about a shoulder of the user. Waist belt 13 and shoulder harness 14 are of customary planar belt-like configuration of a suitable material such as nylon strap and include auxiliary pouch means 15 and 16, respectively. It is to be understood that pouches 15 and 16 are exemplary and other variously designed and positioned pouches may be included and/or substituted. For instance, a pouch 21 may be mounted to the underside of seating portion 11 or to the outside of depending carrier portion 12, as indicated in FIG. 2. Auxiliary pouches are useful for carrying child care products as well as user beverages or the like.

Both waist belt 13 and shoulder harness 14 are adjustable in length in the customary manner by means of adjustment buckles 17, and padding such as padding 19, may be included at selected weight bearing locations. Waist belt 13 and shoulder harness 14 have quick releasable fastener means 18 that include female portion 18*a* and corresponding male portion 18*b*; it understood that other quick release fastening means that permit safe and easy mounting and dismounting of the child are acceptable. With the carrier 10 comfortably strapped to the body of the user as illustrated and described, the user has both hands free so that it is relatively easy to mount and dismount the child as may be desired.

From the foregoing, it may be appreciated that carrier 10 may be mounted to a user by first positioning shoulder harness 14, including pouch means 16, about a shoulder of the user and then connecting the corresponding fastener 18. The waist belt 13, including pouch means 15 is then placed around the waist of the user and likewise fastened with the corresponding fastener 18. The carrier 10 and pouch means 15, 16 are then adjusted as desired.

Figure 4:
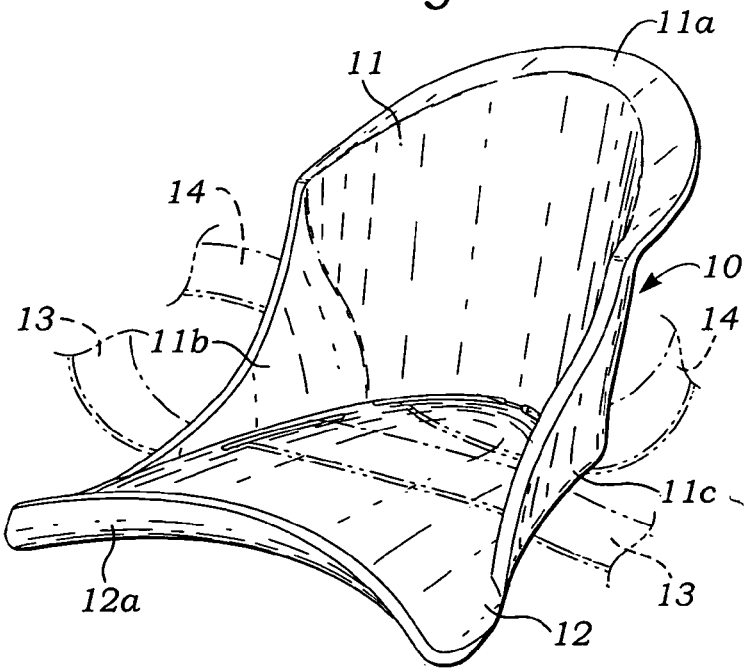
FIG. 4 is a perspective view of the child carrier of FIG. 1 showing the bottom of the seating portion, back of the adult body contoured portion, and contoured right side of the seating portion.

As best seen in FIGS. 2-4, the carrier 10 has two arcuate slots 30 positioned in seating portion 11 proximate the arcuate intersection of seating portion 11 and depending buttress portion 12 for receiving planar shoulder harness 14 therethrough, and two rectangular slots 31 positioned in the upper area of buttress portion 12 for receiving waist belt 13 therethrough. The two slots 30 are coplanar and slightly separated for the harness 14 strap to enter through one slot and exit through the other such that the harness 14 lies flat on the inner side of buttress portion 12 as indicated in FIG. 4. The two slots 31 are positioned in contoured buttress portion 12 diverging slightly downwardly at a slight acute angle to the vertical, one proximate the intersection of buttress section 12 and contoured side portion 11*b*, and one proximate the intersection of buttress portion 12 and contoured side portion 11*c*, the waist belt 13 fed through one slot and out through the other with the waist belt 13 lying flat on the inner side of buttress portion 12 as indicated in FIG. 4.

In accordance with the above, there has been shown and described an improved child carrier. While the invention has been shown and described directed to an exemplary embodiment thereof, it is obvious that various modifications and changes may be made to the exemplary embodiment without departing from the inventive concepts contained herein.

What is claimed is:

1. A child carrier seat to be worn by a user for supporting and transporting a child, comprising:

a child seat having a buttress support portion and a seating portion;

said buttress support portion downwardly depending from said seating portion and contoured for abutting the body of said user;

said seating portion is configured for receiving a child in a position facing said user;

said seating portion extends outwardly and upwardly from said buttress support portion in a continuous generally concave manner and in combination is laterally contoured downwardly in a continuous generally convex configuration, the combination of rearward concavity and lateral convexity urging the child forwardly on said seat against said user;

said seating portion including first and second sides downwardly depending from said seating portion to connect and brace said seating portion and said buttress support portion;

said first and second sides are concavely contoured to allow said child's legs to assume a natural position thereby increasing comfort and decreasing restriction of blood circulation; and wherein said seating portion extends rearward from said buttress support portion terminating in an upturned portion to provide an incline whereby with movement said child tends to slide forward toward said user.

2. The child carrier seat of claim 1 wherein said upturned portion is configured to contravene said child sliding backwardly on said seat.

3. The child carrier seat of claim 2 wherein said buttress support portion includes means for attachment of a belt whereby said carrier seat can be worn about the waist of the user.

4. The child carrier seat of claim 3 wherein said seating portion includes means for attachment of a harness whereby said carrier seat can be worn supported over the shoulder of the user.

5. The child carrier seat of claim 1 including a belt fed through slots in said buttress portion and a harness fed through slots in said seating portion.

* * * * *